US011988200B2

(12) United States Patent
Zou

(10) Patent No.: US 11,988,200 B2
(45) Date of Patent: May 21, 2024

(54) MULTI-STAGE COMPRESSOR

(71) Applicant: DONGGUAN XIANMA ELECTROMECHANICAL CO., LTD., Guangdong (CN)

(72) Inventor: Menglin Zou, Guangdong (CN)

(73) Assignee: DONGGUAN XIANMA ELECTROMECHANICAL CO., LTD, Guangdong (CN)

( * ) Notice: Subject to any disclaimer, the term of this patent is extended or adjusted under 35 U.S.C. 154(b) by 277 days.

(21) Appl. No.: 17/473,335

(22) Filed: Sep. 13, 2021

(65) Prior Publication Data

US 2021/0404455 A1 Dec. 30, 2021

Related U.S. Application Data

(63) Continuation of application No. PCT/CN2020/095580, filed on Jun. 11, 2020.

(30) Foreign Application Priority Data

Apr. 13, 2020 (CN) ..... 202010287697.0

(51) Int. Cl.
*F04B 25/00* (2006.01)
*F04B 25/02* (2006.01)
(Continued)

(52) U.S. Cl.
CPC ..... *F04B 25/02* (2013.01); *F04B 25/00* (2013.01); *F04B 39/0005* (2013.01);
(Continued)

(58) Field of Classification Search
CPC ..... F04B 25/00; F04B 25/02; F04B 39/0005; F04B 39/02; F04B 39/122; F04B 39/123;
(Continued)

(56) References Cited

U.S. PATENT DOCUMENTS 1,245,643 A * 11/1917 Planck ..... F04B 25/02 123/58.5
4,173,433 A * 11/1979 Anderson ..... F04B 25/02 417/439

(Continued)

FOREIGN PATENT DOCUMENTS

CN 201526440 7/2010
CN 103256201 8/2013

(Continued)

OTHER PUBLICATIONS

European Office Action (Application No. 20930840.2) dated Oct. 12, 2022 (15 pages).

(Continued)

*Primary Examiner* — Charles G Freay
(74) *Attorney, Agent, or Firm* — NIXON PEABODY LLP; Jeffrey L. Costellia

(57) ABSTRACT

A compressor, which includes a cylinder block and a piston assembly arranged inside the cylinder block; the piston assembly includes a first piston, a second piston arranged inside the first piston, and a movable assembly connected to the first piston, and the movable assembly is configured to drive the first piston and the second piston to reciprocate; the cylinder block is provided with a first compression chamber that defines a space for the first piston to move up and down; the cylinder block is provided with a gas storage chamber for storing the gas after the first compression, and the gas storage chamber is connected to the first compression chamber; and the cylinder block is also provided with a second compression chamber that defines a space for the second piston to move up and down, and the second compression chamber is connected to the gas storage chamber.

10 Claims, 10 Drawing Sheets

(51) Int. Cl.

| | |
|---|---|
| ***F04B 39/00*** | (2006.01) |
| ***F04B 39/02*** | (2006.01) |
| ***F04B 39/12*** | (2006.01) |
| ***F04B 39/16*** | (2006.01) |
| ***F04B 53/00*** | (2006.01) |
| ***F04B 53/08*** | (2006.01) |
| ***F04B 53/10*** | (2006.01) |
| ***F04B 53/14*** | (2006.01) |
| ***F04B 53/16*** | (2006.01) |
| ***F04B 53/18*** | (2006.01) |
| *F04B 17/03* | (2006.01) |
| *F04B 35/04* | (2006.01) |
| *F04B 39/06* | (2006.01) |

(52) U.S. Cl.
CPC ..... *F04B 39/02* (2013.01); *F04B 39/0292* (2013.01); *F04B 39/122* (2013.01); *F04B 39/123* (2013.01); *F04B 39/125* (2013.01); *F04B 39/16* (2013.01); *F04B 53/006* (2013.01); *F04B 53/08* (2013.01); *F04B 53/10* (2013.01); *F04B 53/143* (2013.01); *F04B 53/16* (2013.01); *F04B 53/18* (2013.01); *F04B 17/03* (2013.01); *F04B 35/04* (2013.01); *F04B 39/06* (2013.01); *F04B 2205/05* (2013.01)

(58) Field of Classification Search
CPC ..... F04B 39/125; F04B 35/04; F04B 35/06; F04B 35/0292; F04B 35/16; F04B 53/006; F04B 53/08; F04B 53/10; F04B 53/143; F04B 53/16; F04B 53/18; F04B 17/03; F04B 2203/05
See application file for complete search history.

(56) References Cited

U.S. PATENT DOCUMENTS

| | | | | |
|---|---|---|---|---|
| 4,345,880 | A * | 8/1982 | Zanarini | F04B 25/02 417/264 |
| 5,525,044 | A | 6/1996 | Chen | |
| 2009/0047144 | A1 | 2/2009 | Leece et al. | |

FOREIGN PATENT DOCUMENTS

| | | |
|---|---|---|
| CN | 205533066 | 8/2016 |
| CN | 206017099 | 3/2017 |
| CN | 206054220 | 3/2017 |
| CN | 207634269 | 7/2018 |
| CN | 108571436 | 9/2018 |
| CN | 207999339 | 10/2018 |
| EP | 2 916 001 A1 | 9/2015 |
| JP | 59-060080 | 4/1984 |
| JP | 10-331768 | 12/1998 |
| WO | WO-2015/099538 | 7/2015 |

OTHER PUBLICATIONS

Extended European Search Report for European Application No. 20 93 0840.2, dated Feb. 3, 2023 (18 pages).
International Search Report for PCT/CN2020/095580, dated Jan. 7, 2021.

* cited by examiner

MULTI-STAGE COMPRESSOR

CROSS REFERENCE TO RELEVANT APPLICATIONS

The present application claims priority to Chinese patent application No. 202010287697.0 filed with the Chinese National Intellectual Property Administration on Apr. 13, 2020, titled "NEW COMPRESSOR", the entire content of which is incorporated into the present application by reference.

TECHNICAL FIELD

The present disclosure relates to the field of mechanical technology; in particular, the present disclosure relates to a compressor.

BACKGROUND

A compressor is a driven fluid machine which pressurizes a low-pressure gas into a high-pressure gas. It suctions in a low-temperature and low-pressure gas from the outside, drives a piston through operation of an electric motor so as to compress the gas, and discharges a high-temperature and high-pressure gas to a discharge pipe.

Traditional compressors are divided into single-cylinder compressors and multi-cylinder compressors, in each of which an electric motor is used to directly drive the compressor so that a crankshaft rotates and drives a connecting rod to make a piston reciprocate, thereby causing a change in the volume of the cylinder.

The single-cylinder compressor has a low compression efficiency and a poor compression capacity, and it is impossible for it to obtain a high-pressure gas through a single compression. The electric motor and the piston generate a large amount of heat during use and are prone to damage, which will reduce a service life of the compressor. The multi-cylinder compressor has a large volume, a complicated structure, and a high production cost; moreover, a failure rate is high during asynchronous compressions of multiple pistons, and the maintenance is difficult, which also further reduces the compression efficiency.

SUMMARY

In view of the above problems, an embodiment of the present disclosure is proposed to provide a compressor that overcomes or at least partially solves the above problems.

In order to solve the above problems, the embodiment of the present disclosure discloses a compressor, comprising a cylinder block and a piston assembly arranged inside the cylinder block;

wherein the piston assembly comprises a first piston, a second piston arranged inside the first piston, and a movable assembly connected to the first piston, and the movable assembly is configured to drive the first piston and the second piston to reciprocate;

the cylinder block is provided with a first compression chamber that defines a space for the first piston to move up and down, and when the first piston reciprocates in the first compression chamber, a gas outside the cylinder block is suctioned in, and the gas is compressed to generate a gas after first compression;

the cylinder block is provided with a gas storage chamber for storing the gas after the first compression, and the gas storage chamber is connected to the first compression chamber; and the cylinder block is further provided with a second compression chamber that defines a space for the second piston to move up and down, the second compression chamber is connected to the gas storage chamber, when the second piston reciprocates in the second compression chamber, the gas after the first compression is suctioned from the gas storage chamber, and the gas after the first compression is compressed to generate a gas after second compression.

Optionally, the cylinder block is provided with a penetrating spacer block, the spacer block extends from a top to a bottom of the cylinder block, a space between an outer wall of the spacer block and an inner wall of the cylinder block defines the first compression chamber, and an inner wall space of the spacer block defines the second compression chamber, to allow the first compression chamber and the second compression chamber both to be arranged inside the cylinder block, and to allow the second compression chamber to be surrounded by the first compression chamber.

Optionally, the first compression chamber is provided with a first gas inlet port and a first gas outlet port, the second compression chamber is provided with a second gas inlet port and a second gas outlet port, both the first gas inlet port and the second gas outlet port communicate with an outer wall of the cylinder block, and the first gas outlet port and the second gas inlet port communicate with the gas storage chamber.

Optionally, the first compression chamber is provided with a first opening and closing space, one end of the first gas inlet port communicates with the first opening and closing space, the first opening and closing space is provided with a first gas inlet valve, and an end where the gas storage chamber and the first gas outlet port are connected is provided with a first gas outlet valve; and wherein the second compression chamber is provided with a second opening and closing space, one end of the second gas inlet port and one end of the second gas outlet port communicate with the second opening and closing space, the second opening and closing space is provided with a second gas inlet valve, and the other end of the second gas inlet port is provided with a second gas outlet valve;

when the first piston moves from a top dead center to a bottom dead center, the first gas inlet valve opens the first gas inlet port, and the first gas outlet valve seals the first gas outlet port;

when the first piston moves from the bottom dead center to the top dead center, the first gas inlet valve seals the first gas inlet port, and the first gas outlet valve opens the first gas outlet port;

when the second piston moves from a top dead center to a bottom dead center, the second gas inlet valve opens the second gas inlet port, and the second gas outlet valve seals the second gas outlet port; and when the second piston moves from the bottom dead center to the top dead center, the second gas inlet valve seals the second gas inlet port, and the second gas outlet valve opens the second gas outlet port.

Optionally, further comprising a filter component arranged at the first gas inlet port, and an elastic component which is connected to the second gas outlet valve by touching;

when the first piston moves from the top dead center to the bottom dead center, the first gas inlet valve opens the first gas inlet port, and the gas outside the cylinder block enters the first compression chamber after being filtered by the filter component;

when the second piston moves from the bottom dead center to the top dead center, the second gas outlet valve opens the second gas outlet port, and the second gas outlet valve compresses the elastic component under the action of the gas after the second compression; and when the second piston moves from the top dead center to the bottom dead center, the elastic component bounces the second gas outlet valve to an original position, to allow the second gas outlet valve to seal the second gas outlet port.

Optionally, further comprising a cylinder liner arranged on an inner wall of the cylinder block, a sealing ring is arranged at a position where the cylinder liner touches the inner wall of the cylinder block, and the cylinder block is provided with a spacer block;

an outer wall of the spacer block is provided with a sealing piston for sealing the first compression chamber; and the first piston is provided with at least one gas ring for sealing the first compression chamber, and/or an oil scraper ring for scraping grease.

Optionally, a bottom of the cylinder block is equipped with lubricating oil or grease;

a side of the cylinder block is provided with a breathing hole for maintaining oil pressure balance at the bottom of the cylinder block;

a side of the cylinder block is provided with an oil mirror for observing the volume of the lubricating oil at the bottom of the cylinder block; and the bottom of the cylinder block is provided with an oil drain hole for draining the lubricating oil at the bottom of the cylinder block.

Optionally, the first piston is provided with a positioning seat, the second piston is arranged on the positioning seat, and the second piston is pushed by the positioning seat to move synchronously with the first piston; and the positioning seat is provided with a leak hole for the lubricating oil at a bottom of the cylinder block to flow into the second piston.

Optionally, further comprising a heat dissipation component for dissipating heat, and a purification component for detecting and filtering the gas after the second compression;

the heat dissipation component is arranged on an outer wall of the cylinder block;

the purification component comprises a filter connected to the second compression chamber, and a tester connected to the filter; and the tester is provided with a vent valve for discharging gas, an output connector for connecting with an external device, a pressure gauge for gas detection, and a safety valve.

Optionally, the movable assembly comprises a connecting rod connected to the first piston and the second piston, a crankshaft connected to the connecting rod, a gear connected to the crankshaft, and an electric motor connected to the gear, and wherein the crankshaft is provided with a crankshaft bearing, an oil seal and a gear bearing, the crankshaft bearing is connected to the oil seal, the crankshaft is connected to the gear through the crankshaft bearing and the gear bearing, the cylinder block is provided with a housing, and the electric motor is arranged in the housing.

The embodiment of the present disclosure has the following advantages: the present disclosure proposes a compressor, which may include a cylinder block and a piston assembly arranged inside the cylinder block. The cylinder block of the present disclosure is divided into a first compression chamber and a second compression chamber. Two times of compression can be realized in a single cylinder block. Moreover, a first piston and a second piston can move synchronously in the cylinder block, which can greatly reduce the volume, improve the compression efficiency, increase the compression capacity, and meet more compression requirements. Furthermore, through the transmission of gear, the amount of heat generated by the electric motor and the pistons during use can be reduced, which reduces work wear, while also being capable of prolonging the service life of the entire compressor and reducing the operating and use cost.

Described above is merely an overview of the inventive scheme. In order to more apparently understand the technical means of the disclosure to implement in accordance with the contents of specification, and to more readily understand above and other objectives, features and advantages of the disclosure, specific embodiments of the disclosure are provided hereinafter.

BRIEF DESCRIPTION OF THE DRAWINGS

In order to explain the technical solution in the embodiments of the disclosure or related arts more clearly, the drawings used in the description of the embodiments or related arts will be briefly introduced below. Obviously, the drawings in the following description are only some embodiments of the disclosure, and for those of ordinary skill in the art, other drawings can be obtained according to these drawings without paying creative labor.

DETAILED DESCRIPTION

To make the above purposes, features and advantages of the present disclosure clearer and easily understood, the present disclosure will be described in further detail below in conjunction with the accompanying drawings and specific implementations.

One of the core ideas of the embodiment of the present disclosure is to provide two different compression chambers in a cylinder block, so that two times of compression are performed in the two different compression chambers, which enables the machine to have a small volume and the compressed gas to have a high pressure. In addition, a heat dissipation component is provided on the side of the cylinder block, which can effectively solve the problem of cooling the compressor and increase the service life of the entire compressor.

Figure 1:
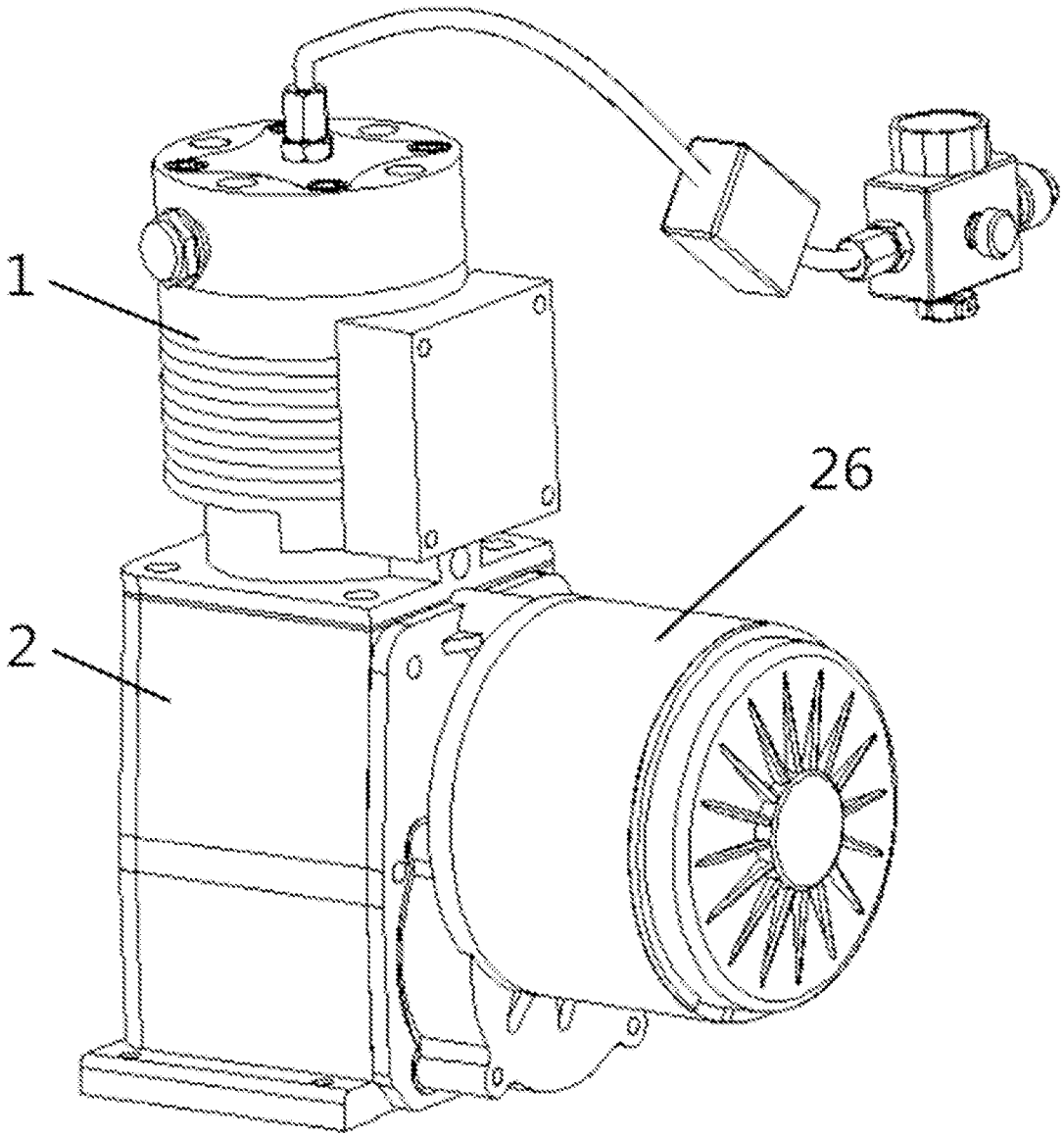
FIG. 1 schematically shows an isometric view of a first embodiment of a compressor of the present disclosure.

With reference to FIG. 1, an isometric view of a first embodiment of a compressor of the present disclosure is shown. The compressor can perform two times of compression on the air.

Specifically, with reference to FIGS. 1-4, the compressor may include a cylinder block 1 and a piston assembly 2 arranged in the cylinder block. The piston assembly 2 is surrounded by the cylinder block 1 and reciprocates in the cylinder block 1 to compress gas in the cylinder block 1, thereby generating a compressed gas.

It should be noted that the cylinder block 1 may be made of a material which is resistant to high temperature and has a high hardness, such as an alloy, a plastic or an organic material. The cylinder block 1 may be a cube, a cylinder, or an irregularly-shape body. The volume of the cylinder block 1 may be adjusted according to actual needs. If a large volume of gas needs to be compressed, the volume of the cylinder block 1 can be appropriately increased, so that the volume of the gas in the cylinder block 1 can be increased. If a small volume of gas needs to be compressed, the volume of the cylinder block 1 can be appropriately reduced, so that the volume of the gas in the cylinder block 1 can be reduced.

Figure 2:
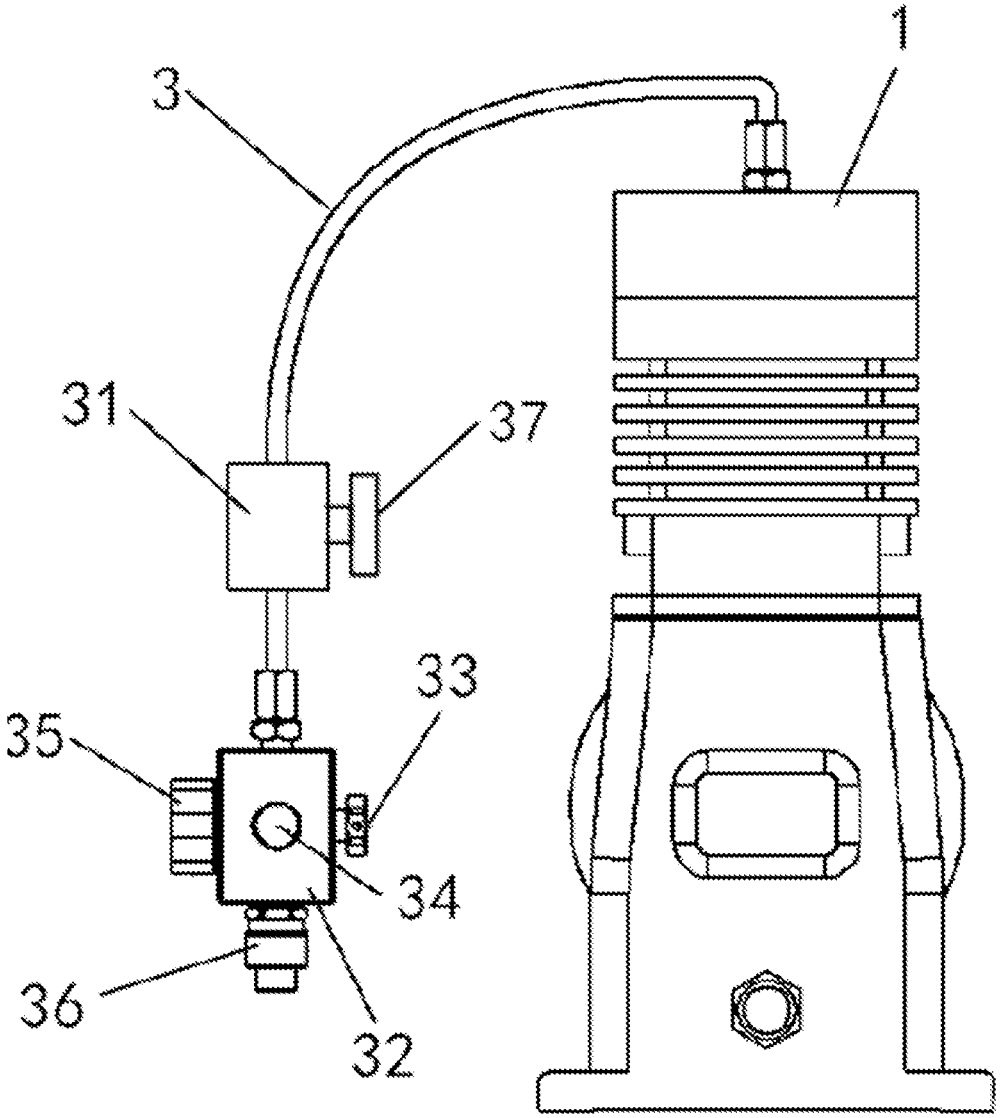
FIG. 2 schematically shows a front view of the first embodiment of the compressor of the present disclosure.
Figure 3:
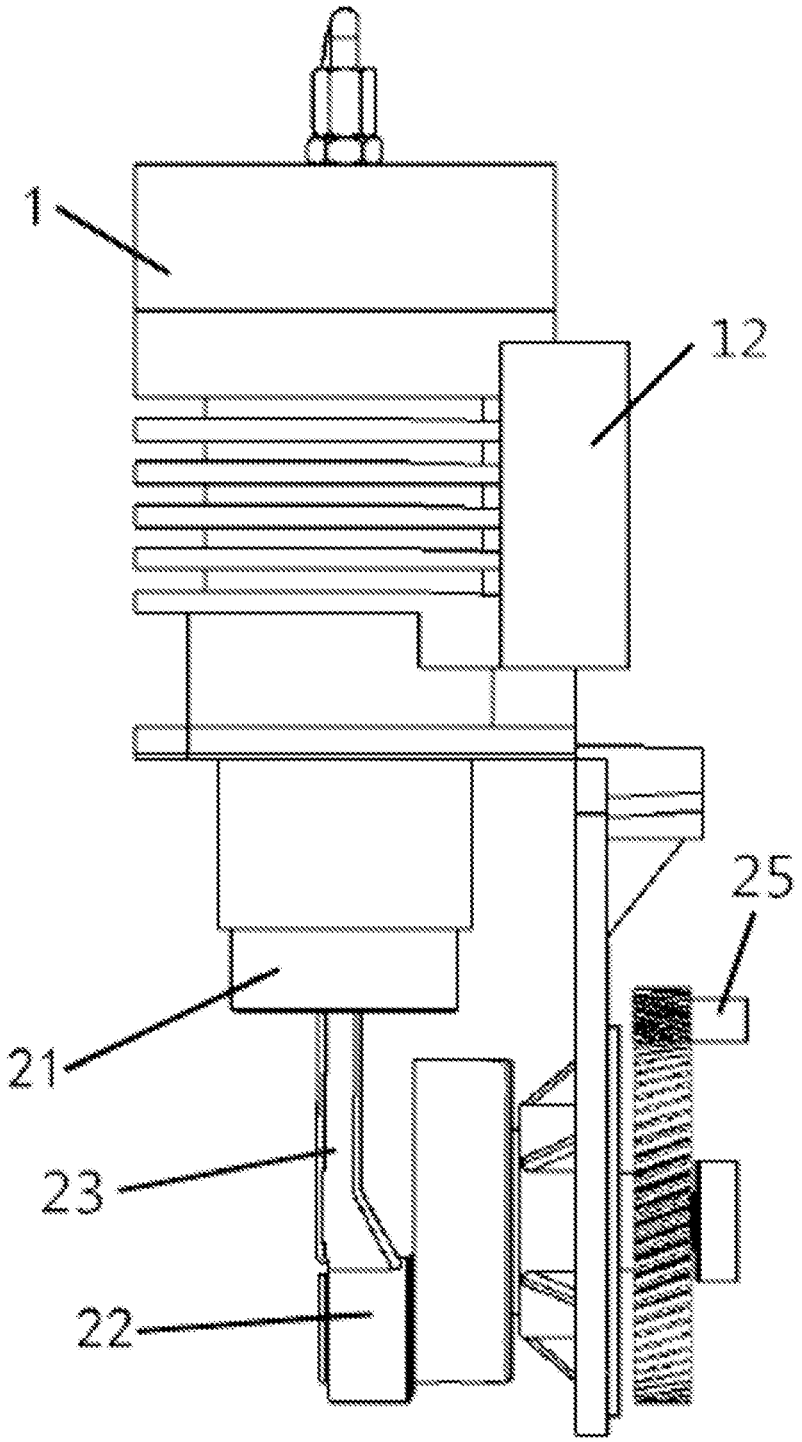
FIG. 3 schematically shows a side view of the first embodiment of the compressor of the present disclosure.
Figure 4:
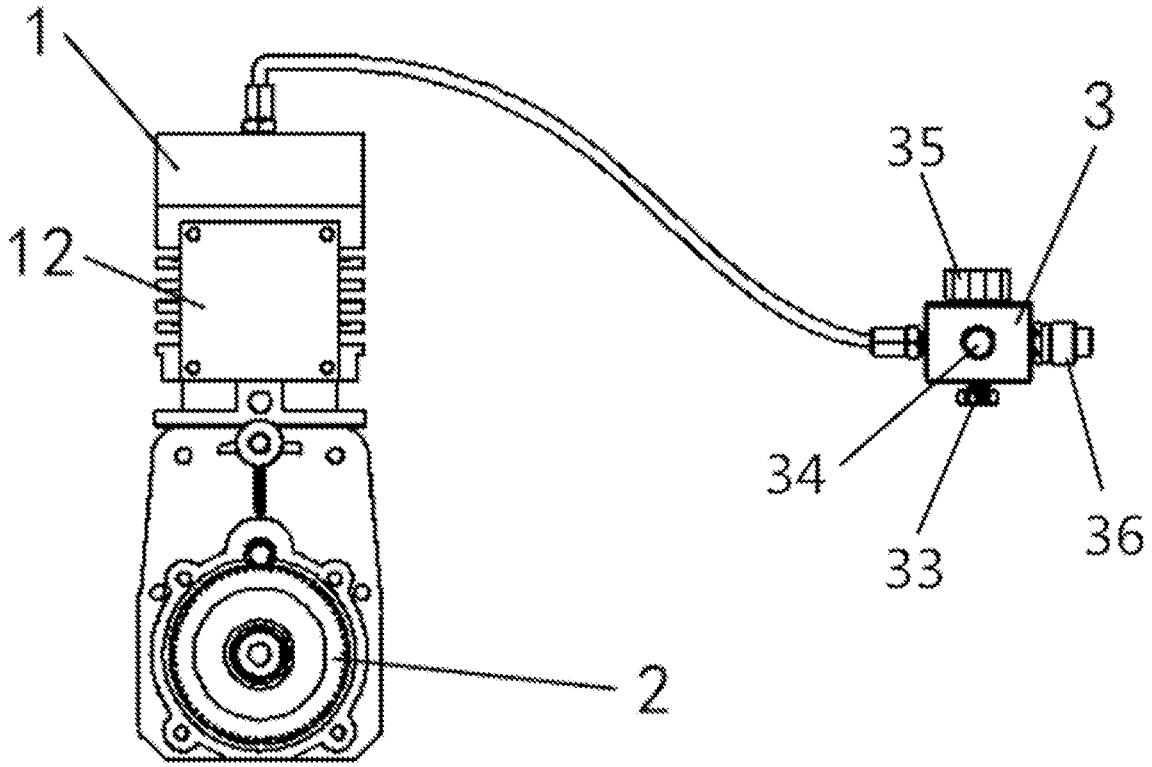
FIG. 4 schematically shows a rear view of the first embodiment of the compressor of the present disclosure.
Figure 5:
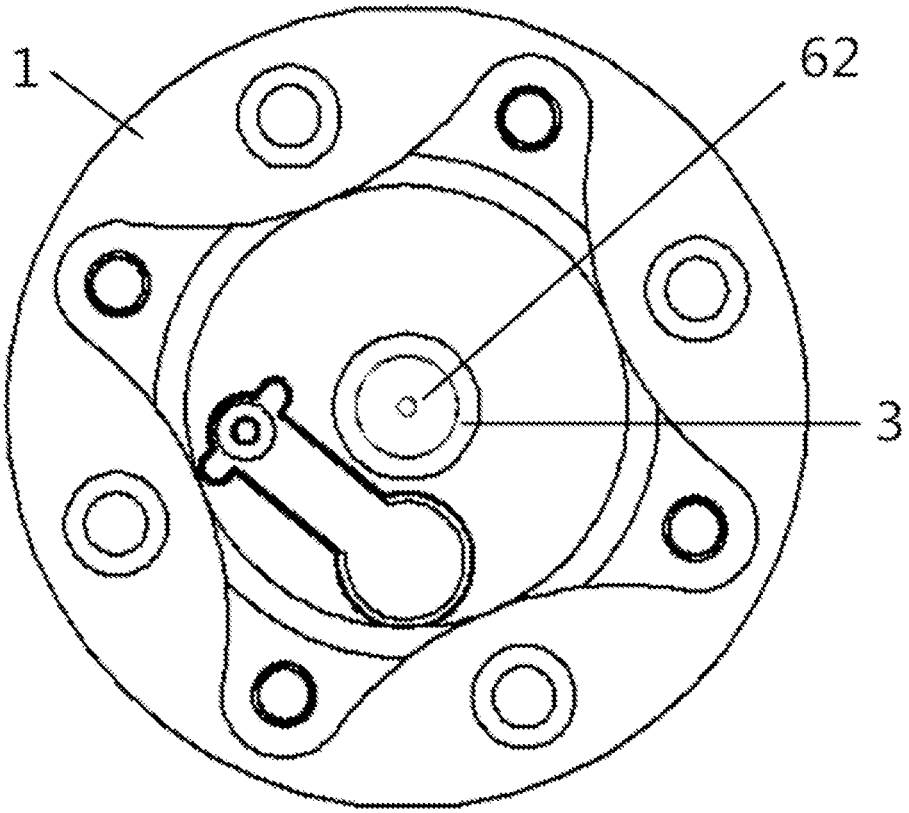
FIG. 5 schematically shows a top view of the first embodiment of the compressor of the present disclosure.

With reference to FIG. 2, a front view of the first embodiment of the compressor of the present disclosure is shown. In this embodiment, the compressor may also be provided with a purification component 3, which may be connected to the cylinder block 1 and which may be configured to purify and filter the compressed gas discharged from the cylinder block 1 and to perform a pressure test.

With reference to FIG. 2, in a specific implementation, the purification component 3 may include a filter 31 and a tester 32 that are connected to each other. The filter 31 may be connected to the cylinder block 1; specifically, it may be connected to the cylinder block 1 through a connection pipe. The tester 32 may be provided with a vent valve 33 for discharging gas. A safety valve 34 for protecting the tester 32, a pressure gauge 35 for testing the gas pressure, and an output connector 36 for connecting with an external device may be provided on the sides of the vent valve 33. A pollutant discharge valve 37 is provided on the side of the filter 31 for discharging pollutants from the filter 31.

Preferably, a filter material of the filter 31 may be composed of various different filter materials such as filter cotton and/or molecular sieve and/or activated carbon, etc. The use of various different filter materials can effectively improve the filtering effect. In actual use, the technician may make adjustments according to actual needs, to which the present disclosure does not impose any limitation. In addition, it should be noted that the vent valve 33 and the safety valve 34 may be adjusted according to the actual volume of the cylinder block 1 or the volume of the compressed gas or the pressure of the compressed gas, and the pressure gauge 35 may also be adjusted according to actual test requirements. The output connector may be specifically adjusted according to a connector of the external device.

In use, after the gas is compressed in the cylinder block 1, the compressed gas can be discharged. The compressed gas may be filtered by the filter 31 and flow into the pressure gauge 35 for pressure test, and finally may be discharged from the vent valve 33. If the compressed gas needs to be delivered to the external device, the output connector 36 may be connected to the external device, and then the compressed gas can be discharged.

Reference is made to FIGS. 3 to 7, which respectively show a side view of the first embodiment of the compressor of the present disclosure, a rear view of the first embodiment of the compressor of the present disclosure, a top view of the first embodiment of the compressor of the present disclosure, a schematic structural view of a second gas outlet valve of the first embodiment of the compressor of the present disclosure, and a schematic view of compressing of the first embodiment of the compressor of the present disclosure. In this embodiment, the piston assembly 2 may include a piston 21 and a movable assembly 22. The movable assembly 22 is connected to the piston 21, and is configured to control the piston 21 to reciprocate in the cylinder block 1. The piston 21 is configured to compress the gas in the cylinder block 1.

With reference to FIGS. 3 to 7, the movable assembly 22 may include a connecting rod 23, a crankshaft 24, an oil seal 29, a crankshaft bearing 28, a gear 25, and an electric motor 26, which are connected in sequence. The connecting rod 23 is connected to the piston 21, a gear bearing 27 is provided on the crankshaft 24, the crankshaft 24 is connected to the gear 25 through the gear bearing 27 and the crankshaft bearing 28, and the gear 25 is directly connected to the electric motor 26. The oil seal 29 is connected to the crankshaft bearing 28, and the oil seal 29 may be an element coated with lubricating oil for playing the roles of lubrication, auxiliary cooling, anti-rust, cleaning, sealing, buffering and the like during use of the crankshaft 24 and the gear 25. During operation, the electric motor 26 drives the gear 25 to rotate, then the gear 25 drives the crankshaft 24 to rotate, and then the crankshaft 24 drives the connecting rod 23 to rotate, so that the connecting rod 23 can drive the piston to reciprocate in the cylinder block 1.

In one of the optional embodiments, a housing 11 may be provided on the side of the cylinder block 1, and the electric motor 26 may be fixedly arranged in the housing so that the electric motor 26 can be protected to avoid damage of the electric motor 26. It should be noted that the housing 11 may be made of a material such as metal or alloy or high-temperature resistant organic material, etc. Preferably, the housing may be a protective sheet metal. In one of the optional embodiments, the housing 11 may also be provided with a handle 111, which may be configured for the user or technician to lift the entire compressor, so as to facilitate the technician in carrying the compressor.

In addition, it should be noted that the electric motor 26 may be a high-power motor, or a high-speed motor, or a high-torque motor. The type of the electric motor 26 may be adjusted according to actual needs. Specifically, by setting a gear ratio, for example, by adjusting the gear ratio of the gear 25, a high-speed electric motor can be converted into a high-torque and low-speed motor, so that the electric motor 26 can drive the crankshaft 24 to move back and forth, thereby reducing the amount of heat generated by the cylinder block 1. In addition, the electric motor 26 may be an electric motor having a voltage of 12V, 24V, 110V, 220V or another voltage, to which the present disclosure does not impose any limitation.

With reference to FIGS. 3 to 7, a heat dissipation component 12 may be provided on the side of the cylinder block 1. Specifically, the heat dissipation component 12 may be provided on an outer wall of the cylinder block 1 and is connected to the outer wall of the cylinder block 1 by touching. The heat dissipation component 12 may be configured to dissipate heat from the space inside the cylinder block 1 and stabilize the temperature of the cylinder block 1. If the compressor is overheated during use, the piston or various mechanical parts in the cylinder block 1 will be prone to damage. With the use of the heat dissipation component 12, the temperature of the cylinder block 1 can be appropriately lowered, damage to various mechanical parts can be avoided, and the service life of the product can be prolonged. At the same time, the technician will be facilitated in carrying or moving the entire compressor after heat dissipation. In a specific implementation, the heat dissipation component 12 may be a heat dissipation fan.

Figure 6:
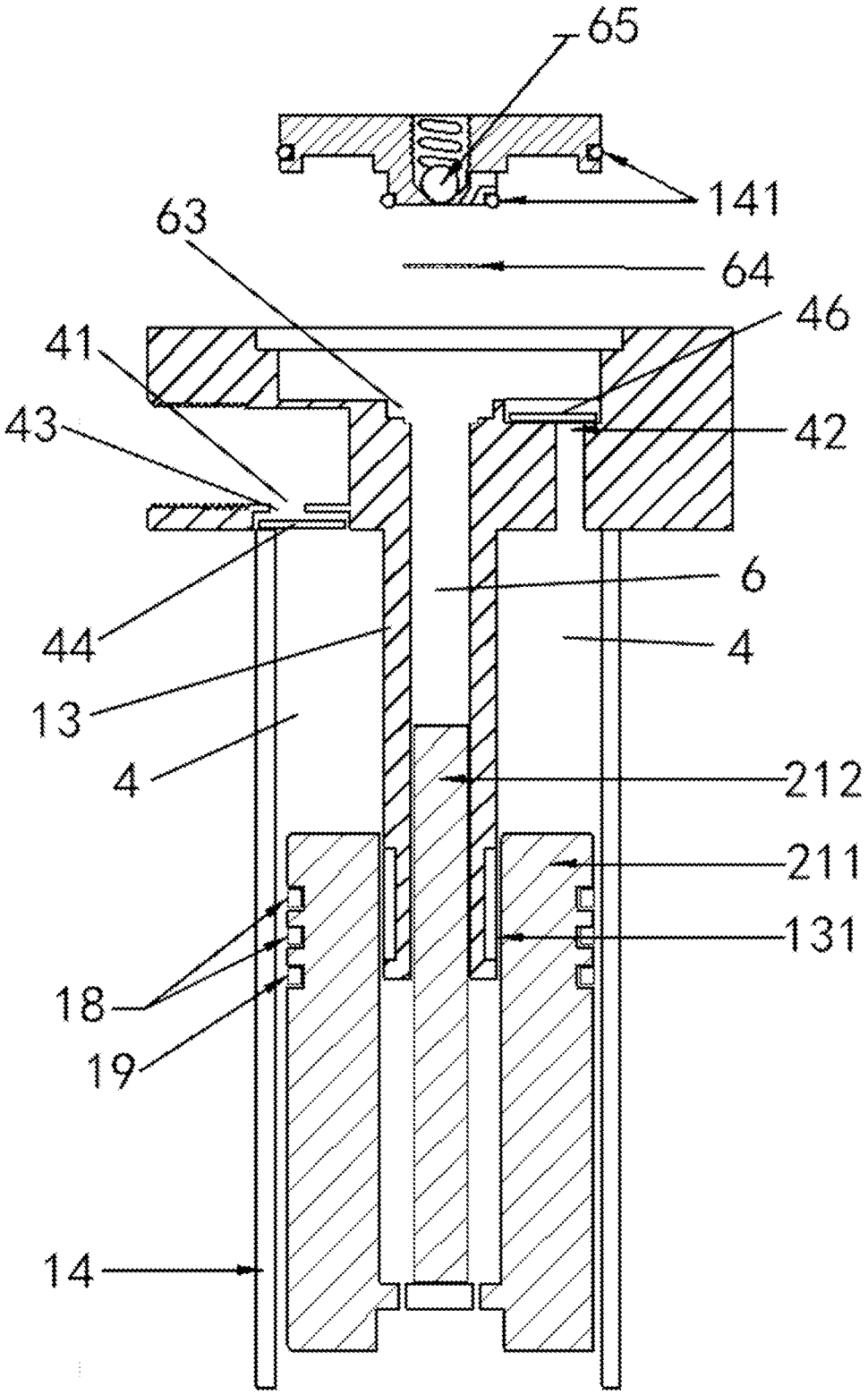
FIG. 6 schematically shows a schematic structural view of a second gas outlet valve of the first embodiment of the compressor of the present disclosure.
Figure 7:
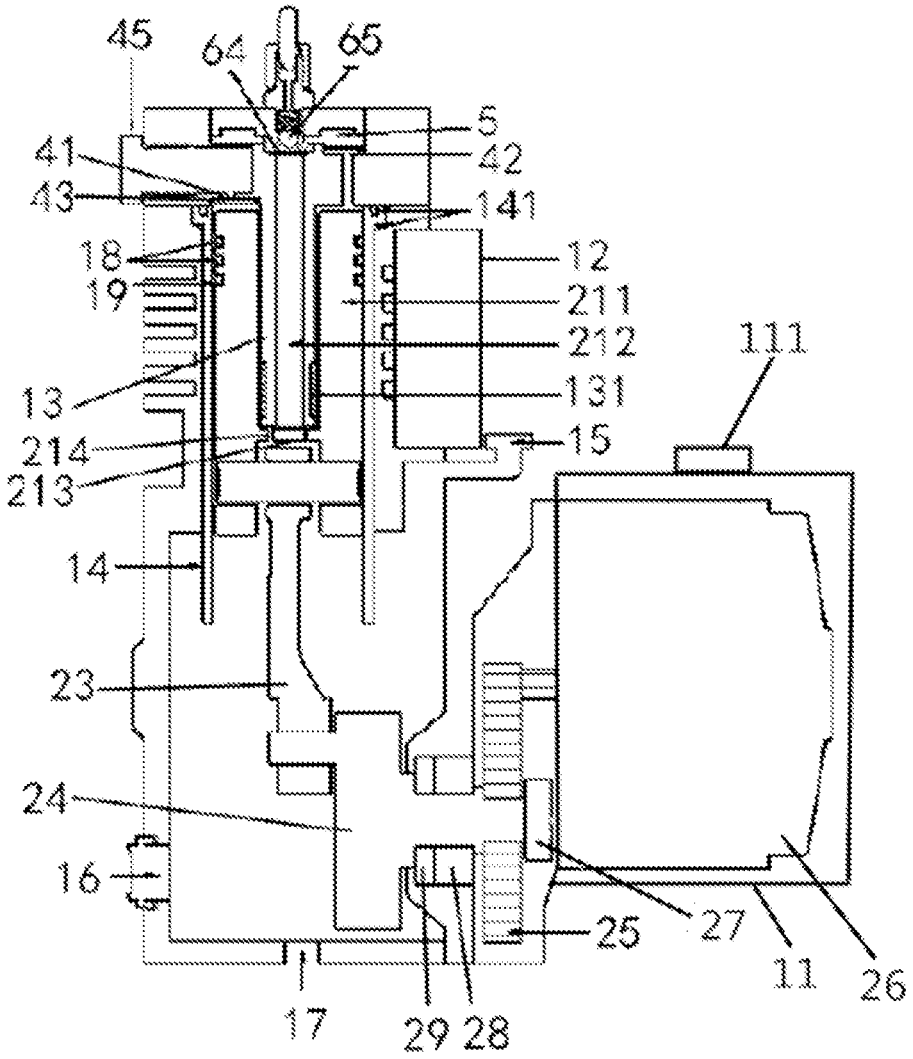
FIG. 7 schematically shows a schematic view of compressing of the first embodiment of the compressor of the present disclosure.
Figure 8:
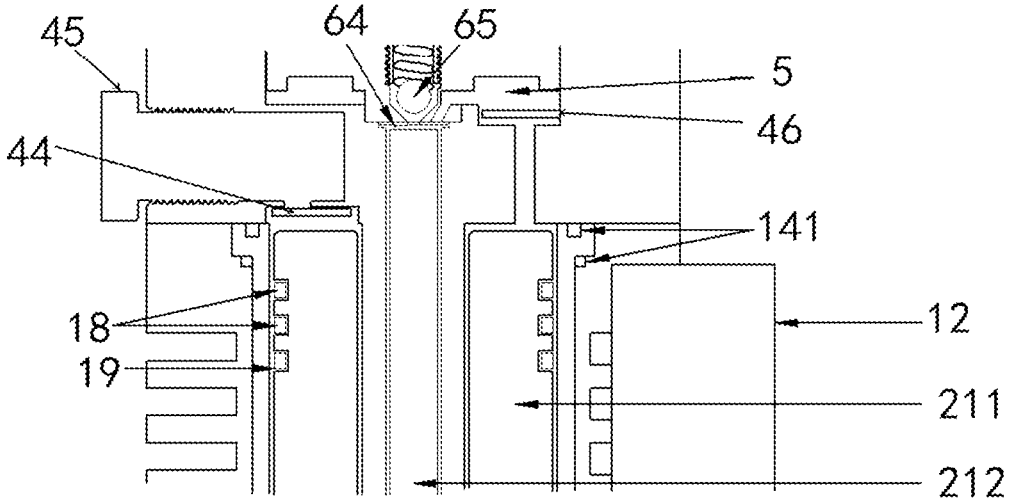
FIG. 8 schematically shows a schematic view of a compressed gas valve of the first embodiment of the compressor of the present disclosure.
Figure 9:
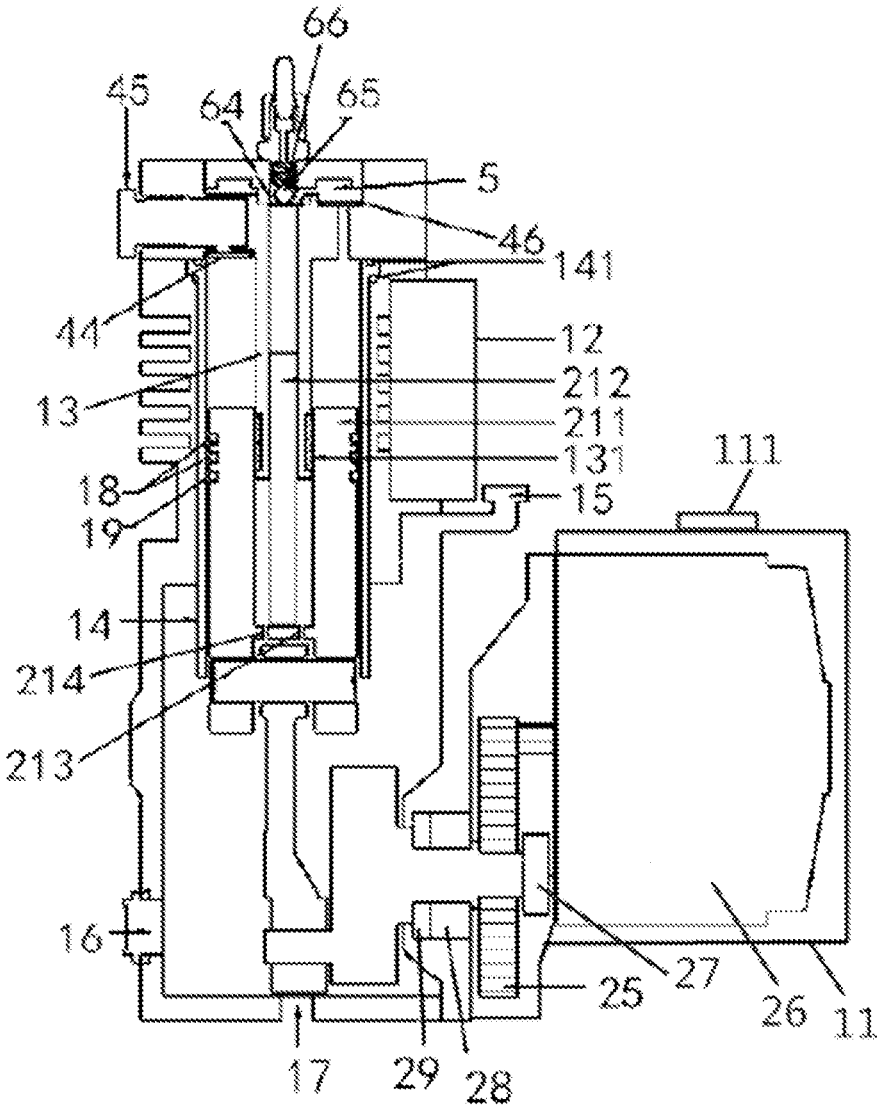
FIG. 9 schematically shows a schematic view of suctioning of the first embodiment of the compressor of the present disclosure.
Figure 10:
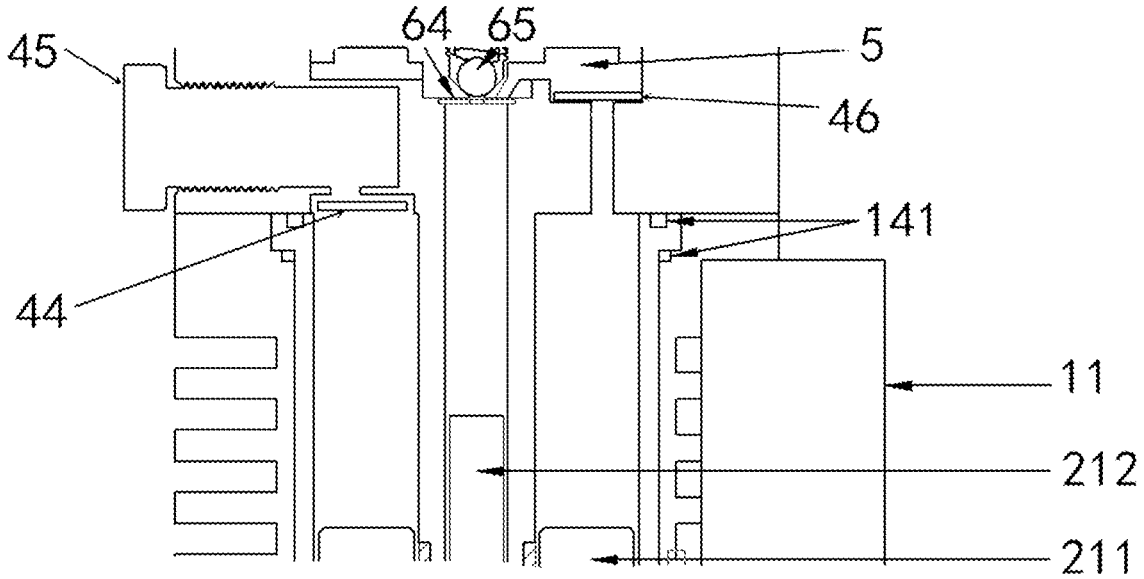
FIG. 10 schematically shows a schematic view of a suctioned gas valve of the first embodiment of the compressor of the present disclosure.
Figure 11:
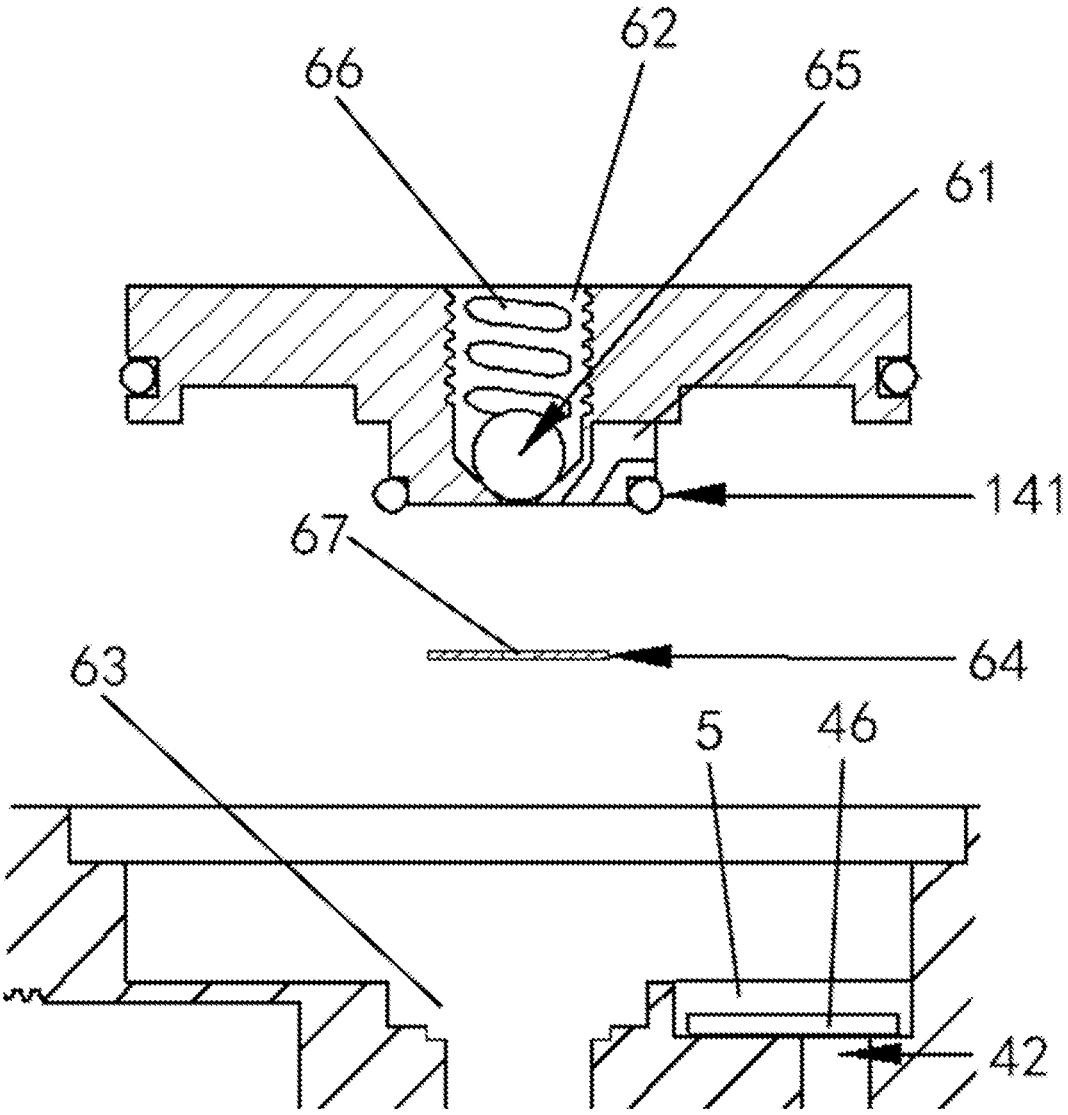
FIG. 11 schematically shows a schematic structural view of the second gas outlet valve of the first embodiment of the compressor of the present disclosure.

Reference is made to FIGS. 6 to 7, which respectively show a schematic structural view of a second gas outlet valve of the first embodiment of the compressor of the present disclosure, and a schematic view of compressing of the first embodiment of the compressor of the present disclosure. Further reference is made to FIGS. 8 to 11, which respectively show a schematic view of a compressed gas valve of the first embodiment of the compressor of the present disclosure, a schematic view of suctioning of the first embodiment of the compressor of the present disclosure, a schematic view of a suctioned gas valve of the first embodiment of the compressor of the present disclosure, and a schematic structural view of the second gas outlet valve of the first embodiment of the compressor of the present disclosure.

In this embodiment, the piston 21 includes a first piston 211 and a second piston 212. The second piston 212 is arranged inside the first piston 211. The first piston 211 may be connected to the connecting rod 23 and controlled by the connecting rod 23 so as to reciprocate inside the cylinder block 1. The crankshaft 24 and the gear 25 are arranged at a bottom of the cylinder block 1 so that the connecting rod 23 is pushed from the bottom, and then the connecting rod 23 drives the first piston 211 and the second piston 212 to reciprocate up and down.

In a specific implementation, a positioning seat 213 may be provided in the first piston 211, and a size of the positioning seat 213 may be matched with a size of the second piston 212 so that the second piston 212 may be arranged in the middle of the positioning seat 213. By providing the positioning seat 213, a support can be provided for the upward movement of the second piston 212. When the entire compressor needs to be cleaned and arranged, the disassembly and assembly also become more convenient. Moreover, the positioning seat 213 enables the second piston 212 to move synchronously with the first piston 211. When the connecting rod 23 pulls the first piston 211 from a top dead center to a bottom dead center, the second piston 212 also moves downward at the same time under the action of gravity, and also moves from a top dead center to a bottom dead center; and when the connecting rod 23 pushes the first piston 211 from the bottom dead center to the top dead center, the second piston 212 also moves from the bottom dead center to the top dead center at the same time due to being pushed by the positioning seat 213. The positioning seat 213 not only can ensure the synchronous movement of the first piston 211 and the second piston 212, but also can reduce the load of the electric motor and reduce the use loss of mechanical parts.

In one of the optional embodiments, one or more leak holes 214 may be provided around a periphery of the positioning seat 213, and the leak holes 214 can allow the lubricating oil at the bottom of the cylinder block 1 to flow to a periphery of the second piston 212 so as to lubricate the second piston 212, which not only can reduce friction of the second piston 212 and lower the temperature of the second piston 212 during the working process, but also can improve the working efficiency and service life of the second piston 212.

In this embodiment, an interior of the cylinder block 1 may have a shape of a cylinder, and a penetrating spacer block 13 is provided inside the cylinder block 1. The spacer block 13 has a cylindrical shape and may extend from the top to the bottom of the cylinder block 1. As can be seen from FIGS. 6 to 11, a space between an outer wall of the spacer block 13 and an inner wall of the cylinder block 1 is a first compression chamber 4. The first compression chamber 4 can define a space for the reciprocating movement of the first piston 211. The piston 211 can compress gas in the first compression chamber 4. In one of the optional embodiments, a height of the first compression chamber 4 may be larger than or equal to a stroke distance from the top dead center to the bottom dead center of the first piston 211. The top dead center is a position where a top of the first piston 211 has a maximum distance from a center of the crankshaft 24, and the bottom dead center is a position where the top of the first piston 211 has a minimum distance from the center of the crankshaft 24. Preferably, the height of the first compression chamber 4 may be equal to the stroke distance from the top dead center to the bottom dead center of the first piston 211, so that the first piston 211 can fully compress the gas in the first compression chamber 4, thereby improving the compression efficiency.

The spacer block 13 can divide the interior of the cylinder block 1 into two chambers for compression by two pistons, thereby reducing the volume of the entire cylinder block and improving the compression efficiency.

In a specific implementation, the shape of the first piston 211 can match with the space in the first compression chamber 4, which not only enables the first piston 211 to move more flexibly in the first compression chamber 4, but also can increase the compression efficiency.

As can be seen from FIGS. 6 to 11, a cylinder liner 14 is arranged on the inner wall of the cylinder block 1, and the cylinder liner 14 can be connected to the inner wall of the cylinder block 1 by touching. The arrangement of the cylinder liner 14 can prevent the first piston 211 from directly contacting the inner wall of the cylinder block 1 during the reciprocating movement, and can prolong the service life of the cylinder block 1 and the first piston 211. Optionally, the cylinder liner 14 may be made of a metal material, a plastic or an organic material, etc.

In actual operation, in order to make the cylinder liner 14 abut with the cylinder block 1, a sealing ring 141 may be provided on the cylinder liner 14, and the sealing ring 141 may be arranged in an area where the cylinder liner 14 and the cylinder block 1 are connected by touching. The sealing ring 141 can make the cylinder liner 14 and the inner wall of the cylinder block 1 be sealed more firmly.

With reference to FIGS. 6 to 11, the first compression chamber 4 is provided with a first gas inlet port 41 and a first gas outlet port 42, and the first gas inlet port 41 may pass through the outer wall of the cylinder block 1, so that the first compression chamber 4 can communicate with the outer wall of the cylinder block 1. Therefore, the gas around the outer wall of the cylinder block 1 can enter the first compression chamber 4 through the first gas inlet port 41 and be compressed in the first compression chamber 4.

Optionally, in an area where the first compression chamber 4 communicates with the first gas inlet port 41, the first compression chamber 4 is provided with a first opening and closing space 43, so that an end of the first gas inlet port 41 can communicate with the first opening and closing space 43. A first gas inlet valve 44 is provided in the first opening and closing space 43. The first gas inlet valve 44 may be configured to close or open the first gas inlet port 41. Specifically, with reference to FIGS. 6 to 9, when the first piston 211 moves from the top dead center to the bottom dead center, the pressure outside the cylinder block 1 is higher than the pressure in the first compression chamber 4, and the gas flows from the outside of the cylinder block 1 to the first compression chamber 4 to push the first gas inlet valve 44 away from the first gas inlet port 41 so that the first gas inlet port 41 is open, and gas can enter the first compression chamber 4 from the outside of the cylinder block 1. When the first piston 211 moves from the bottom dead center to the top dead center, the gas in the first compression chamber 4 is compressed, so that the pressure in the first compression chamber 4 is higher than the gas pressure outside the cylinder block 1. The first gas inlet valve 44 is pressed toward the first gas inlet port 41 under the action of the gas pressure, so that the first gas inlet port 41 is sealed, and at the same time, the first piston 211 discharges the compressed gas in the first compression chamber 4 from the first gas outlet port 42.

In one of the preferred embodiments, the first gas inlet port 41 may be provided with a filter component 45, and the filter component 45 may be a filter cartridge. The filter cartridge may be configured to filter the gas entering the first compression chamber 4 for one time, which can make the compressed air cleaner, and meanwhile can prevent impurities and dust from entering the interior of the cylinder block 1 and affecting the movement of the first piston 211.

With reference to FIGS. 6 to 11, in this embodiment, the cylinder block 1 is provided with a gas storage chamber 5, and the gas storage chamber 5 communicates with the first gas outlet port 42 of the first compression chamber 4, so that the gas discharged from the first compression chamber 4 may be temporarily stored in the gas storage chamber 5. The gas storage chamber 5 may be arranged at the top of the cylinder block 1, and may be specifically arranged according to the position of the first gas outlet port 42. It should be noted that the capacity of the gas storage chamber 5 may be larger than or equal to or smaller than the volume of the compressed gas in the first compression chamber 4, so that the gas compressed in the first compression chamber 4 can be completely stored in the gas storage chamber 5.

In actual operation, since the first piston 211 reciprocates repeatedly, the compressed gas will be generated without stop. In order to prevent the gas generated from the previous compression and the gas generated from the next compression from being accumulated in the gas storage chamber 5, a first gas outlet valve 46 may be provided at a position where the first gas outlet port 42 is connected to the gas storage chamber 5, and the first gas outlet valve 46 may be provided inside the gas storage chamber 5.

In actual operation, when the first piston 211 moves from the top dead center to the bottom dead center in the first compression chamber 4, the gas in the first compression chamber 4 that was compressed by the first piston 211 at the last time is already stored in the gas storage chamber 5, so the pressure in the gas storage chamber 5 is higher than the pressure in the first compression chamber 4, and therefore the first gas outlet valve 46 can seal the first gas outlet port 42; and when the first piston 211 moves from the bottom dead center to the top dead center in the first compression chamber 4, the gas stored in the chamber 5 after the first compression is discharged, and the gas pressure in the first compression chamber 4 gradually increases, so the pressure in the first compression chamber 4 is higher than the pressure in the gas storage chamber 5. Therefore, the gas in the compression chamber 4 pushes the first gas outlet valve 46 away, and the first gas outlet valve 46 opens the first gas outlet port 42, so that the gas in the first compression chamber 4 can enter the gas storage chamber 5. The above process is repeated in such a way.

In this embodiment, the use of the gas storage chamber 5, the first gas inlet valve 44 and the first gas outlet valve 46 enable the entire compressor to achieve the process of natural suction and compression of gas, which can improve the compression efficiency; at the same time, the compressed gas in the first compression chamber 4 will not mix with the gas in the gas storage chamber 5.

With reference to FIGS. 6 to 11, in a preferred embodiment of the present disclosure, the second piston 212 can reciprocate at a position defined in the middle of the spacer block 13. A space defined by the inner wall of the spacer block 13 is a second compression chamber 6. The second compression chamber 6 can limit the reciprocating movement of the second piston 212. Optionally, the spacer block 13 may extend downward from a side of the top of the cylinder block 1 or extend downward from any position of the top of the cylinder block 1. In this embodiment, the spacer block 13 may extend downward from the center of the top of the cylinder block 1, so that the first compression chamber 4 formed by the outer wall of the spacer block 13 and the inner wall of the cylinder block 1 can surround the space (i.e., the second compression chamber 6) formed by the inner wall of the spacer block 13.

Specifically, with reference to FIGS. 6 to 11, a second gas inlet port 61 and a second gas outlet port 62 are provided in the second compression chamber 6. The second gas inlet port 61 may communicate with the gas storage chamber 5, and the second gas outlet port 62 may communicate with the outer wall of the cylinder block 1, so that the gas in the gas storage chamber 5 after the first compression can enter the second compression chamber 6 from the second gas inlet port 61, and be compressed for the second time in the second compression chamber 6 to obtain a gas after the second compression, which is finally discharged from the second gas outlet port 62. In actual operation, the second gas outlet port 62 may be connected to the filter 31 through a pipe.

In order to prevent the gas in the second compression chamber 6 from mixing with the gas in the gas storage chamber 5, and to prevent the gas in the gas storage chamber 5 from mixing with the gas after the second compression, the second compression chamber 6 is provided with a second opening and closing space 63. One end of the second gas inlet port 61 communicates with the second opening and closing space 63, and the other end of the second gas inlet port 61 communicates with the gas storage chamber 5. One end of the second gas outlet port 62 communicates with the second opening and closing space 63, and the other end of the second gas outlet port 62 communicates with the outer wall of the cylinder block 1. A second gas inlet valve 64 is provided in the second opening and closing space 63, and the second gas inlet valve 64 is configured to seal or open the second gas inlet port 61. A second through hole 67 is provided in the second gas inlet valve 64, and the second through hole 67 can match with the second gas outlet port 62.

In addition, in order to avoid leakage of gas pressure in the second compression chamber 6, a second gas outlet valve 65 is provided at an end where the second gas outlet port 62 and the second opening and closing space 63 are connected. The second gas outlet valve 65 may be configured to open or seal the second gas outlet port 62. An elastic component 66 is provided on the side of the second gas outlet valve 65. The elastic component 66 may be connected to the second gas outlet valve 65 by touching, and the elastic component 66 may be configured to reset the second gas outlet valve 65.

With reference to FIGS. 6 to 11, during use, when the connecting rod 23 pulls the first piston 211 to move downward, the second piston 212 also moves from the top dead center to the bottom dead center under the action of its own gravity. The pressure in the second compression chamber 6 is lower than the pressure in the gas storage chamber 5. The gas after the first compression stored in the gas storage chamber 5, which was compressed by the first piston 211 in the first compression chamber 4, pushes the second gas inlet valve 64 away, so that the second gas inlet valve 64 can open the second gas inlet port 61. The gas after the first compression enters the second compression chamber 6. When the second piston 212 moves from the bottom dead center to the top dead center, the gas after the first compression is compressed for the second time in the second compression chamber 6, and the pressure in the second compression chamber 6 is higher than the pressure in the gas storage chamber 5, so that the gas in the second compression chamber 6 pushes the second gas inlet valve 64 toward the second gas inlet port 61. The second gas inlet valve 64 seals the second gas inlet port 61. At the same time, the pressure of the gas compressed for the second time by the second piston 212 is higher than the pressure of the gas outside the cylinder block 1, and the gas after the second compression is discharged from the second gas outlet port 62, thereby pushing the second gas outlet valve 65 away and causing the second gas outlet valve 65 to compress the elastic component 66. After the gas after the second compression in the second compression chamber 6 is discharged, the elastic component 66 resets the second gas outlet valve 65 under the action of elastic force.

In this embodiment, the gas after the first compression stored in the gas storage chamber 5 is suctioned into the second compression chamber 6, and is compressed for the second time by the second piston 212 in the second compression chamber 6, so that multiple times of compression of gas are achieved, the efficiency of gas compression is improved, and the gas compression ratio is increased. Moreover, the second gas inlet valve 64 and the second gas outlet valve 65 can prevent the gas after the second compression in the second compression chamber 6 from mixing with the gas after the first compression stored in the gas storage chamber 5, so that the gas after the first compression can be isolated from the gas after the second compression.

With reference to FIGS. 6 to 11, in this embodiment, the first piston 211 and the second piston 212 can perform the compression synchronously, which can improve the compression efficiency, reduce the power consumption of the electric motor 26, and reduce the loss of mechanical parts.

At the beginning of the operation, there can be no gas in each of the first compression chamber 4, the gas storage chamber 5 and the second compression chamber 6. The connecting rod 23 pulls the first piston 211 and the second piston 212 to move from the top dead centers to the bottom dead centers at the same time, and the gas outside the cylinder block 1 enters the first compression chamber 4. The gas storage chamber 5 does not have the high-pressure gas after the compression in the first compression chamber 4, and there is no gas after the first compression entering the second compression chamber 6. Then, the connecting rod 23 pushes the first piston 211 and the second piston 212 to move from the bottom dead centers to the top dead centers at the same time. The first piston 211 compresses the gas in the first compression chamber 4 for the first time to obtain the gas after the first compression. The gas after the first compression is compressed into the gas storage chamber 5. Since the second compression chamber 6 does not have the gas after the compression in the first compression chamber 4, no gas will be discharged from the second compression chamber 6; then, the connecting rod 23 pulls the first piston 211 and the second piston 212 to move from the top dead centers to the bottom dead centers at the same time, the gas outside the cylinder block 1 enters the first compression chamber 4 again, and at the same time, the gas after the first compression stored in the gas storage chamber 5 enters the second compression chamber 6; then, the connecting rod 23 pushes the first piston 211 and the second piston 212 to move from the bottom dead centers to the top dead centers at the same time, and the first piston 211 once again compresses the gas in the first compression chamber 4 into the gas storage chamber 5, whereas the second piston 212 compresses the gas in the second compression chamber 6 for the second time to obtain the gas after the second compression, and the gas after the second compression is discharged. This process in repeated in this way. Through the above operations, the gas outside the cylinder block 1 can be compressed for two times.

In a specific implementation, since the first piston 211 and the second piston 212 need to continuously operate at a high speed, in order to improve the efficiency of the operation of various components and reduce the risk of damage, a certain volume of lubricating oil or grease may be provided at the bottom of the cylinder block 1. When the first piston 211 and the second piston 212 are working, the lubricating oil or lubricant at the bottom of the cylinder block 1 can reduce friction, protect various components, and meanwhile can also play the roles of lubrication, auxiliary cooling, anti-rust, cleaning, sealing, buffering and the like.

With reference to FIGS. 6 to 11, the side of the cylinder block 1 may be provided with a breathing hole 15 for maintaining the oil pressure balance at the bottom of the cylinder block 1. The side of the cylinder block 1 may be provided with an oil mirror 16 for observing the volume of the lubricating oil at the bottom of the cylinder block 1. The bottom of the cylinder block 1 may be provided with an oil drain hole 17 for draining the lubricating oil at the bottom of the cylinder block 1.

It should be noted that the breathing hole is a through hole, the breathing hole may extend outward from the cylinder block 1, and the position and size of the breathing hole may be adjusted according to actual needs. The oil mirror may be a transparent glass or lens. The user can directly observe the volume of the lubricating oil at the bottom of the cylinder block 1 through the oil mirror. In actual operation, a dividing ruler or scale may be set in the oil mirror so that the volume of the lubricating oil can be known more accurately. In addition, the oil drain hole may be blocked by an oil plug. When the volume of the lubricating oil needs to be adjusted, the user may remove the oil plug and add or reduce the lubricating oil.

With reference to FIGS. 6 to 11, it can be known that in another embodiment, the connecting rod 23 or the crankshaft 24 or the first piston 211 or the second piston 212 may splash the lubricating oil at the bottom of the cylinder block 1 into the first compression chamber 4 or the first compression chamber 6. A sealing piston 131 may be provided on the outer wall of the spacer block 13. The sealing piston may be configured to seal the first compression chamber 4 while also preventing the gas in the first compression chamber 4 from arriving at the bottom of the cylinder block 1 from the first compression chamber 4 and being drained from the hole 15 for maintaining the oil pressure balance. At the same time, the sealing piston may prevent excessive lubricating oil from entering the compression chamber 4. In addition, on the edge where the first piston 211 is in contact with the cylinder liner 14, at least one gas ring 18 that can seal the first compression chamber 4 may be provided in the first piston 211, so that gas can be prevented from flowing away from the sides of the first piston 211 and the cylinder liner 14. In addition, optionally, an oil scraper ring 19 is provided on the first piston 211. The oil scraper ring can scrape away the lubricating oil remaining on the cylinder liner 14, which then flows from the cylinder liner 14 to the bottom of the cylinder block 1, so that the lubricating oil can be recycled.

In another optional embodiment, it is also possible for the first piston 211 to be not provided with the gas ring 18 and the oil scraper ring 19; rather, the first compression chamber 4 may be sealed and the oil in the first compression chamber 4 may be scraped by using the first piston 211 alone.

In a specific implementation, the manufacturing precision of the first piston 211 and the first compression chamber 4 may be increased during the design and production, so that the first piston 211 may abut with the inner wall of the first compression chamber 4 as much as possible. For example, a diameter of an inner ring of the first compression chamber 4 is 50 mm, and a diameter of the first piston 211 is 49.99 mm, so that there is a gap of 0.01 mm between the first piston 211 and the first compression chamber 4, thus making it possible to make the first piston 211 and the inner wall of the first compression chamber 4 be in a nearly completely abutting state. In use, since the first piston 211 moves at a high speed and it almost abuts with the inner wall of the first compression chamber 4, the first piston 211 can scrape away the lubricating oil on the inner wall of the first compression chamber 4, and since the first piston 211 and the first compression chamber 4 almost completely abut with each other, the air at the bottom cannot enter the first compression chamber 4, so that the first piston 211 can seal the first compression chamber 4.

The present disclosure provides a compressor, which may include a cylinder block and a piston assembly arranged inside the cylinder block. The compressor provided by the present disclosure has a simple structure and is convenient to use. A spacer block is provided in the cylinder block, and the interior of the cylinder block can be divided into two compression chambers, so that two times of compression can be realized in one cylinder block. Moreover, the volume of the cylinder block can be reduced, and the production cost can be reduced. In use, the first piston and the second piston can perform a compression movement synchronously in the cylinder block, which can greatly improve the compression efficiency, increase the compression capacity, and meet more compression requirements. Furthermore, the electric motor and the pistons can be cooled during use, which can reduce work wear, while also being capable of prolonging the service life of the entire compressor and reducing the operating and use cost.

The embodiments in this specification are described progressively, the differences from other embodiments are emphatically stated in each embodiment, and the similarities of these embodiments may be cross-referenced.

Although the preferred embodiments of the embodiments of the present disclosure have been described, those skilled in the art can make additional changes and modifications to these embodiments once they learn the basic creative concept. Therefore, the appended claims are intended to be interpreted as including the preferred embodiments and all changes and modifications falling within the scope of the embodiments of the present invention.

Finally, it should be noted that relational terms such as "first" and "second" in this specification are merely used to distinguish one entity or operation from the other one, and do not definitely indicate or imply that these entities or operations have any actual relations or sequences. In addition, the term "comprise" or "include" or other variations are intended to refer to non-exclusive inclusion, so that a process, method, article or device comprising a series of elements not only comprises these elements listed, but also comprises other elements that are not clearly listed, or inherent elements of the process, method, article or device. Unless otherwise clearly specified, an element defined by the expression "comprise a" shall not exclusive of other identical elements in a process, method, article or device comprising said element.

The compressor provided by the present disclosure are introduced in detail above, specific examples are used in this specification to expound the principle and implementation of the present disclosure, and the description of the above embodiments is merely used to assist those skilled in the art in understanding the method and core concept thereof of the present disclosure. In addition, those ordinarily skilled in the art can make changes to the specific implementation and invention scope based on the concept of the present disclosure. So, the contents of the specification should not be construed as limitations of the present disclosure.

The invention claimed is:

1. A compressor, comprising a cylinder block and a piston assembly arranged inside the cylinder block;

wherein the piston assembly comprises a first piston, a second piston arranged inside the first piston, and a movable assembly connected to the first piston, and the movable assembly is configured to drive the first piston and the second piston to reciprocate;

the cylinder block is provided with a first compression chamber that defines a space for the first piston to move up and down, and when the first piston reciprocates in the first compression chamber, a gas outside the cylinder block is suctioned in, and the gas is compressed to generate a gas after first compression;

the cylinder block is provided with a gas storage chamber for storing the gas after the first compression;

the cylinder block is further provided with a second compression chamber that defines a space for the second piston to move up and down, when the second piston reciprocates in the second compression chamber, the gas after first compression is suctioned from the gas storage chamber, and the gas after the first compression is compressed to generate a gas after second compression;

a positioning seat is provided in the first piston, the second piston is detachably arranged inside the positioning seat, and the positioning seat pushes the second piston to move at the same time with the first piston.

2. The compressor according to claim 1, wherein the cylinder block is provided with a penetrating spacer block, the spacer block extends from a top towards a bottom of the cylinder block, a space between an outer wall of the spacer block and an inner wall of the cylinder block defines the first compression chamber, and an inner wall space of the spacer block defines the second compression chamber, to allow the first compression chamber and the second compression chamber both to be arranged inside the cylinder block, and to allow the second compression chamber to be surrounded by the first compression chamber.

3. The compressor according to claim 1, wherein the first compression chamber is provided with a first gas inlet port and a first gas outlet port, the second compression chamber is provided with a second gas inlet port and a second gas outlet port, both the first gas inlet port and the second gas outlet port communicate with an outer wall of the cylinder block, and the first gas outlet port and the second gas inlet port communicate with the gas storage chamber.

4. The compressor according to claim 3, wherein the first compression chamber is provided with a first opening and closing space, one end of the first gas inlet port communicates with the first opening and closing space, the first opening and closing space is provided with a first gas inlet valve, and an end where the gas storage chamber and the first gas outlet port are connected is provided with a first gas outlet valve; and wherein the second compression chamber is provided with a second opening and closing space, one end of the second gas inlet port and one end of the second gas outlet port communicate with the second opening and closing space, the second opening and closing space is provided with a second gas inlet valve, and the other end of the second gas outlet port is provided with a second gas outlet valve;

when the first piston moves from a first top dead center to a first bottom dead center, the first gas inlet valve opens the first gas inlet port, and the first gas outlet valve seals the first gas outlet port;

when the first piston moves from the first bottom dead center to the first top dead center, the first gas inlet valve seals the first gas inlet port, and the first gas outlet valve opens the first gas outlet port;

when the second piston moves from a second top dead center to a second bottom dead center, the second gas inlet valve opens the second gas inlet port, and the second gas outlet valve seals the second gas outlet port; and when the second piston moves from the second bottom dead center to the second top dead center, the second gas inlet valve seals the second gas inlet port, and the second gas outlet valve opens the second gas outlet port.

5. The compressor according to claim 4, further comprising a filter component arranged at the first gas inlet port, and an elastic component which is connected to the second gas outlet valve by touching;

when the first piston moves from the first top dead center to the first bottom dead center, the first gas inlet valve opens the first gas inlet port, and the gas outside the cylinder block enters the first compression chamber after being filtered by the filter component;

when the second piston moves from the second bottom dead center to the second top dead center, the second gas outlet valve opens the second gas outlet port, and the second gas outlet valve compresses the elastic component under the action of the gas after the second compression; and when the second piston moves from the second top dead center to the second bottom dead center, the elastic component bounces the second gas outlet valve to an original position, to allow the second gas outlet valve to seal the second gas outlet port.

6. The compressor according to claim 1, further comprising a cylinder liner arranged on an inner wall of the cylinder block, a sealing ring is arranged at a position where the cylinder liner touches the inner wall of the cylinder block, and the cylinder block is provided with a spacer block;

an outer wall of the spacer block is provided with a sealing piston for sealing the first compression chamber; and the first piston is provided with at least one gas ring for sealing the first compression chamber, and/or an oil scraper ring.

7. The compressor according to claim 1, wherein a bottom of the cylinder block is equipped with lubricating oil;

a side of the cylinder block is provided with a breathing hole for maintaining oil pressure balance at the bottom of the cylinder block;

a side of the cylinder block is provided with an oil mirror for observing the volume of the lubricating oil at the bottom of the cylinder block; and the bottom of the cylinder block is provided with an oil drain hole for draining the lubricating oil at the bottom of the cylinder block.

8. The compressor according to claim 7, wherein the positioning seat is provided with a leak hole for the lubricating oil at a bottom of the cylinder block to flow into the second piston.

9. The compressor according to claim 1, further comprising a heat dissipation component for dissipating heat, and a purification component for detecting and filtering the gas after the second compression;

the heat dissipation component is arranged on an outer wall of the cylinder block;

the purification component comprises a filter connected to the second compression chamber, and a tester connected to the filter; and the tester is provided with a vent valve for discharging gas, an output connector for connecting with an external device, a pressure gauge for gas detection, and a safety valve.

10. The compressor according to claim 1, wherein the movable assembly comprises a connecting rod connected to the first piston and the second piston, a crankshaft connected to the connecting rod, a gear connected to the crankshaft, and an electric motor connected to the gear, and wherein the crankshaft is provided with a crankshaft bearing, an oil seal and a gear bearing, the crankshaft bearing is connected to the oil seal, the crankshaft is connected to the gear through the crankshaft bearing and the gear bearing, the cylinder block is provided with a housing, and the electric motor is arranged in the housing.

* * * * *